United States Patent [19]

Weis

[11] 4,204,678

[45] May 27, 1980

[54] TENNIS PLAYING APPARATUS

[76] Inventor: Ray P. Weis, 404-14th St. SE., Austin, Minn. 55912

[21] Appl. No.: 824,446

[22] Filed: Aug. 15, 1977

[51] Int. Cl.[2] ..... A63B 61/00

[52] U.S. Cl. ..... 273/29 A

[58] Field of Search ..... 273/26 R, 26 A, 26 E, 273/29 A, 58 C, 95 A, 176 FB, 177 A, 177 B, 181 J, 182 R, 35 R, 184 B, 185 D, 196, 197 R, 197 A, 199 A, 200 B, 181 R, 184 R; 272/76, 78; 124/7, 8, 36, 41

[56] References Cited

U.S. PATENT DOCUMENTS

| | | | |
|---|---|---|---|
| 216,590 | 6/1878 | Wright | 124/7 |
| 1,962,087 | 6/1934 | Cone | 273/26 R |
| 2,080,958 | 5/1937 | Beasley et al. | 273/26 R |
| 2,578,313 | 12/1951 | Moseley | 273/29 A |
| 2,712,487 | 7/1955 | Jaediker | 273/95 A |
| 3,924,852 | 12/1975 | Schleeger | 273/29 A |
| 4,042,237 | 8/1977 | Moran | 273/29 A |

FOREIGN PATENT DOCUMENTS

| | | | |
|---|---|---|---|
| 152905 | 11/1950 | Australia | 273/185 D |
| 2232334 | 1/1975 | France | 273/29 A |
| 183146 | 7/1922 | United Kingdom | 273/200 B |

*Primary Examiner*—Richard C. Pinkham
*Assistant Examiner*—T. Brown
*Attorney, Agent, or Firm*—Williamson, Bains, Moore & Hansen

[57] ABSTRACT

A tennis playing apparatus utilizes a hollow base, an upright rigid post member having a bifurcated receiver at its upper end, and an elastically flexible wand member that carries a tennis ball at its upper end and which is movable from a nesting position against the receiver to a second position spaced from the receiver in response to striking of the tennis ball by a tennis racket. Magnetic attraction between the wand member and the post member decreases oscillation of the wand member and releasably retains it against the receiver. The wand member includes an upright shaft and a cap unit at the upper end of the shaft with the tennis ball being fixed to the housing of the cap unit. The cap unit is slidably movable relative to the shaft to move between upper and lower displaced positions and is spring loaded to return to an equilibrium position intermediate between the displaced positions, thereby closely simulating the movement of a free ball when the tennis ball is struck by the racket. Alarm means are provided to indicate and identify badly aimed blows with the racket which would result in poorly placed return balls.

10 Claims, 9 Drawing Figures

TENNIS PLAYING APPARATUS

BACKGROUND OF THE INVENTION

The invention relates to the field of tennis playing and practice devices and provides an apparatus by which one can develop his skill with a tennis racket without the need for a large court area and by which one may be taught to properly strike the ball in even a relatively small room or other training area.

Over the years many tennis training devices have been developed and tested, but none of the known devices provides a generally acceptable tennis training tool. For example, it is not sufficient to merely provide a ball-type target which the player can strike with a racket. It is critical that the player be able to differentiate a proper stroke from an improper one. There is little benefit in training one to strike a ball so hard that it will be driven out of play or so poorly that it will strike the net. With the now known training apparatuses, a player has no way of knowing with reasonable certainty whether his stroke is within the range of acceptability or whether it is poor angled and unsatisfactory. A training apparatus which differentiates acceptable and unacceptable racket blows is needed.

Another serious shortcoming of the existing tennis apparatuses is that most have a ball or ball-like target rigidly fixed to the end of a pole or arm, and a tennis player striking such a rigidly attached ball does not get the feel of striking a live or free ball. When the ball is rigidly confined to the end of such an arm, it simply does not respond, act or feel the same to a tennis player as a live or free ball. Accordingly, the present devices do not provide a ball-like target which feels like a free ball and therefore the player does not become accustomed to the feel of a free tennis ball. Accordingly, it would be desirable to provide an apparatus which is able to capture the feel of a live ball while still constraining it sufficiently to use the device in a relatively small area.

Another shortcoming of many known tennis apparatuses is that after being struck, they tend to spin or oscillate for an unreasonably long period before stabilizing to receive the next blow. It is desirable that a training apparatus return the ball to its initial position rapidly.

Still another shortcoming of the known tennis playing apparatuses is that they are generally cumbersome, occupy substantial space, and sometimes even require permanent anchorage to a court or floor. The invention disclosed herein provides a solution to these problems and represents a substantial improvement in tennis playing apparatuses.

SUMMARY OF THE INVENTION

The invention comprises a tennis playing or training apparatus in which a portable but stable base supports a generally upright post member and a flexibly movable, upright wand member that moves between an initial position abutting against the post member and a displaced position, the wand member being flexed to return to the post member after displacement by a blow from a tennis racket.

The post member has a bifurcated receiver with a pair of laterally extending arms which diverge from a central apex in which the wand member is releasably received and nested. Magnetic attraction between the wand member and the apex is utilized to quickly damp out oscillation of the wand member and to retain the wand member against the post member.

The wand member includes a shaft anchored to the base and further includes a cap unit movably mounted to the upper end of the shaft and slidable between an intermediate rest position and upper and lower displaced positions adjacent the rest position. A tennis ball is fixed to the cap unit and provides a target means for the racket. Because the cap unit is spring loaded to return to the rest position from either displaced position, it gives the cap unit and attached tennis ball a floating effect when struck by the tennis racket. This results in a very close simulation of the feel of an actual tennis ball being struck and avoids the rigid, dead feel of a ball which is rigidly fixed to the end of a pole or arm.

In order to indicate whether a player's blow applied to the ball is satisfactory or unacceptable, alarm means are included to indicate when an unacceptable blow is rendered. Movement of the cap unit relative to the shaft is utilized to mechanically actuate a mechanical chime alarm or, in an alternative embodiment, to close one or more sensor switches to electrically actuate a buzzer or alarm bell.

The advantages and novel features which characterize the invention are set out with particularity in the claims attached hereto and forming a part of this description. For a full understanding of the invention and the objects and advantages obtained through its use, reference should be made to the drawings which form a further part hereof and to the accompanying description in which is illustrated and described the preferred embodiments of the invention.

DESCRIPTION OF THE PREFERRED EMBODIMENTS

Figure 1:
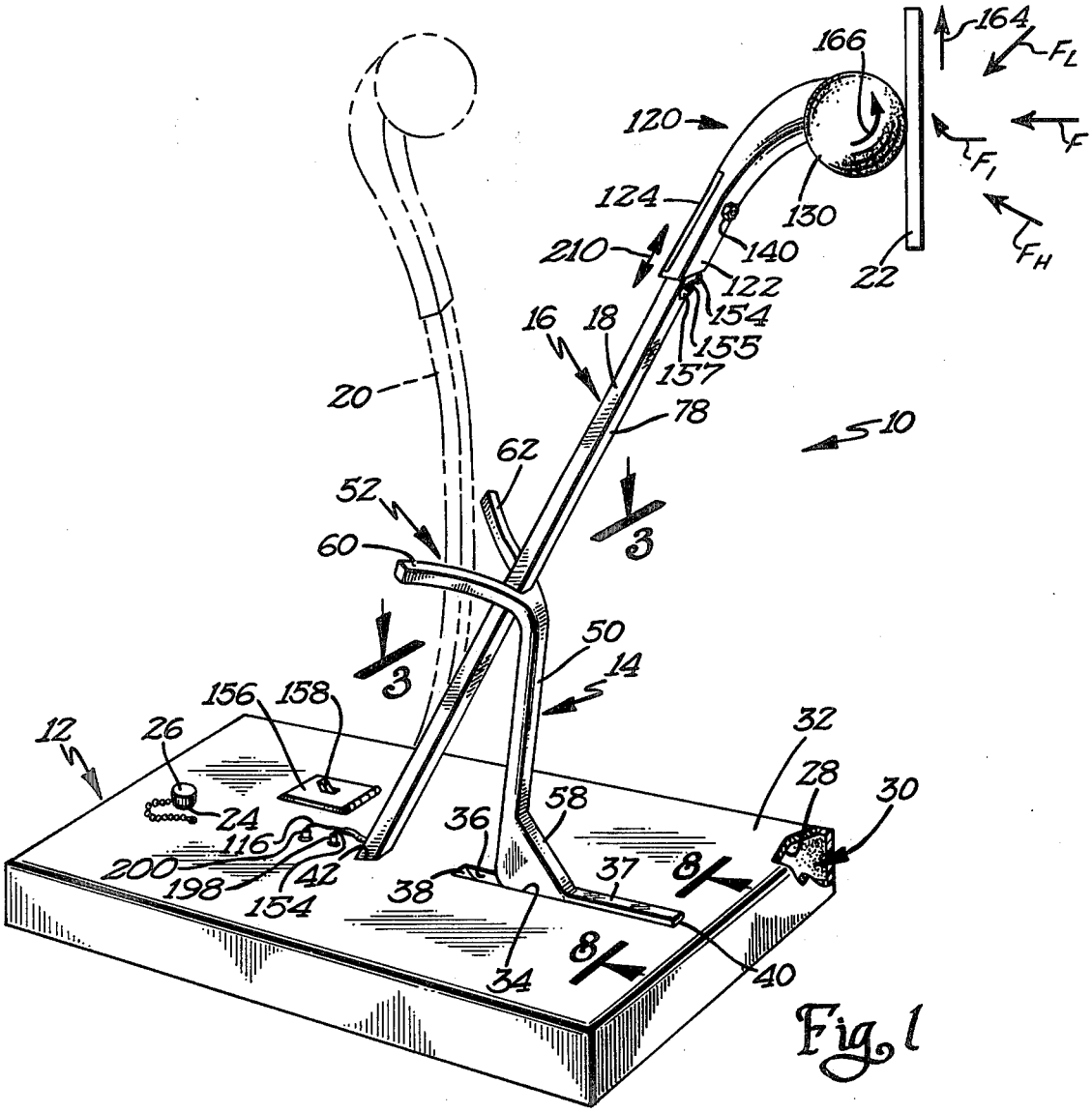
FIG. 1 is a perspective view, partially in phantom, showing an embodiment of the tennis playing apparatus and indicating initial and displaced positions of the wand member.

Referring now to FIG. 1, a tennis playing apparatus 10 is comprised of a base 12, a generally upright post member 14 and an elongated wand member 16 which is flexibly movable from an initial position 18 to a second position 20 in response to a blow to the wand member by a tennis racket 22.

The supporting base 12 may be formed of any appropriate material capable of providing stability and acceptable foundational support for the post member 14 and wand member 16, but it is preferred that the base 12 be formed of a plastic or plastic-like material and that the base be a generally hollow rectangular body provided with an interior cavity 28 and a filling aperture 24 which is threaded to receive a cover 26 thereon. The presence of an interior cavity 28 allows the base to be relatively light weight and easily transported from one place to another, while permitting the base to have the necessary weight and mass needed for stability by filling the cavity 28 with a removable ballast 30. It is contemplated that when the tennis playing apparatus 10 is in normal operation, the base 12 will have its chamber 28 filled with sand, water, or other appropriate ballast 30, as shown. While the base 12 has been shown as being of a rectangular configuration, it should be understood that other shapes may be substituted so long as they provide adequate stability for the members 14 and 16, and such alternative shapes are within the purview of the invention.

Figure 8:
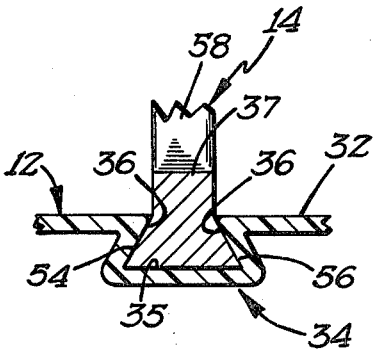
FIG. 8 is a cross sectional view of the tongue taken in the direction of arrows 8—8 of FIG. 1.

The base 12 has an upper surface 32 toward the rear of which is a generally straight horizontal groove 34 which extends forwardly along the base. The groove 34, as best shown in FIG. 8, is widest along its bottom 35 and has upwardly extending, inwardly angled sidewalls 36 which cooperate to retain and carry an insertable tongue 37 which is an integral part of the post member 14, to be described further hereafter. As best shown in FIG. 1, at the entry end 38, the groove 34 has bottom 35 curving upwardly to meet the upper surface 32 of the base. The rearward end 40 of the groove 34 ends abruptly with the tongue 37 bearing against the end 40.

Figure 2:
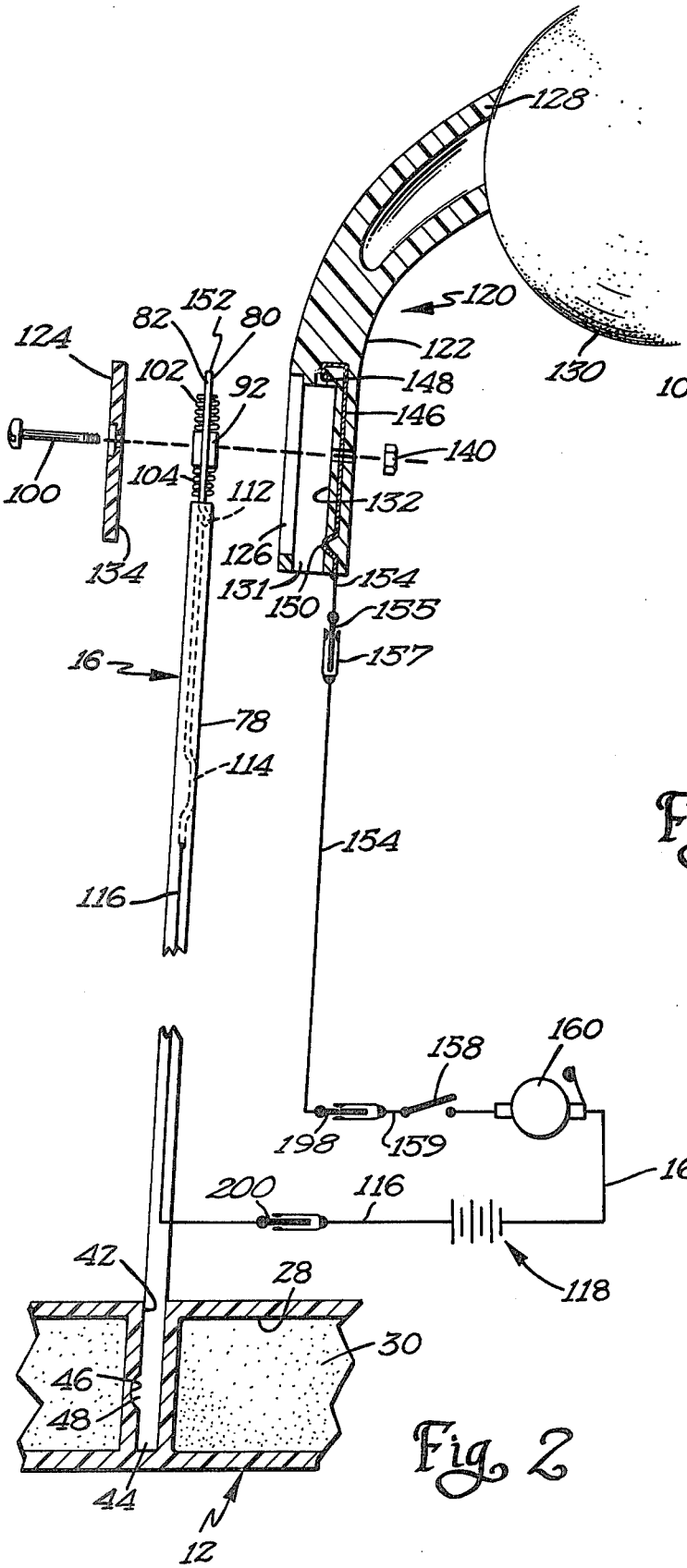
FIG. 2 is a partial side elevation view taken partly in section of the embodiment of FIG. 1 and including an electrical schematic diagram for an alarm means useful with the invention.

Referring now to FIGS. 1 and 2, the base 12 is provided with a generally upright but inclined socket 42 for receiving and carrying the lower end 44 of wand member 16. The socket 42, which has a generally rectangular cross sectional configuration substantially identical to the cross section of the wand member but slightly larger so as to receive it, is provided with a concave depression of detent 46 into which a boss 48 is mateably received so as to retain the wand member securely but releasably in the socket 42.

The post member 14 may be formed of any appropriate material but is preferably molded of plastic or plastic-like material and has a lower generally horizontally inclined, elongated tongue 37 and an upwardly extending mast 50 whose upper end terminates in a bifurcated receiver 52.

The tongue 37, as shown in FIG. 8, has an outwardly, downwardly diverging pair of side surfaces 54 and 56 which are mateably received in the groove 34 and lockably retained therein during operation. To reinforce the juncture of mast 50 and tongue 37, an enlarged fillet 58 extends between the mast and tongue and provides additional support to the mast 50, making it possible for the mast 50 to flex slightly above the fillet in response to impact by the returning wand member while eliminating overstrain at the juncture. Aside from such slight flexing, the post member 14 is preferably substantially rigid and the integral receiver 52 has diverging laterally outwardly extending bifurcations or arms 60 and 62 which serve as wand receiving means to receive the wand member 16 when in the first position 18 and to guide the wand member into the apex 64 of the receiver as will be further described hereafter.

Positioned at the apex 64 defined by the arms 60 and 62 is a wand receiving surface 66, the surface 66 and the adjoining inner surfaces 68 and 70 of the arms cooperating to closely nestably receive the wand member 16 therebetween when the wand member is in its initial position 18. The surfaces 66, 68 and 70 closely confine the wand member and cooperate to substantially diminish oscillation or bouncing of the wand member as it returns to the initial position 18. The surfaces 66 and 68 do not, however, tightly grip or lock the wand member therebetween, since the member 16 must be reasonably free to move in response to blows from the racket 22.

Figure 3:
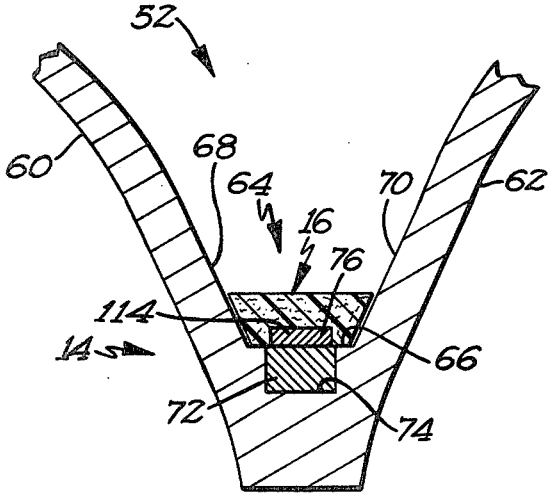
FIG. 3 is a cross sectional view of the receiver taken in the directions of arrows 3—3 of FIG. 1.

Referring now to FIG. 3, a magnet 72 is positioned within a recess 74 of the receiving surface 66 and rigidly retained therein by any means known to the art, the outerface of the magnet being substantially flush with the surface 66. Alternatively, the post member 14 may be molded with the magnet 72 at the shown position therein. The wand member 16 is provided with a magnetic medium such as a magnet or a plate on strip 82 formed of ferromagnetic material which is adjacent and directly confronts the magnet 72 when the wand member 16 is in the initial position 18. This use of a magnet on one member and a magnetic medium on the other member tends to releasably retain the wand member 16 in the initial or nesting position 18 and cooperates with the arms 60 and 62 to damp out oscillatory or bouncing motion of the wand member 16 as it returns to initial position 18 after being displaced by impact with the tennis racket 22. Naturally, the magnet 72 could be placed in the wand member 16 and the magnetic plate 114 placed in the apex 64 of the receiver 52 if desired, and such alternatives are within the scope of the invention.

The wand member 16 has a generally straight, elongated shaft 78 which is formed of substantially elastic, flexible or springy material such as fiber glass such that when the shaft 16 is elastically flexed from the initial position 18 to a displaced position 20, an internal restoring force is generated in the shaft 78 causing it to return to the initial position 18. The shaft 78 may have various cross sectional configurations, but a trapezoidal configuration such as that shown in FIG. 3 is preferred so as to be complementary to the receiver 52 and nest readily with the receiver. The trapezoidal configuration also aids in returning the wand shaft to initial position 18 with a minimum of oscillation, as will be further described hereafter. The lower end 44 of the shaft is removably inserted into the socket 42 and selectively retained therein by engagement between boss 48 and detent 46. Preferably when the shaft is in initial position 18, it is already elastically flexed or stressed to bear against the post member 14.

Figure 4:
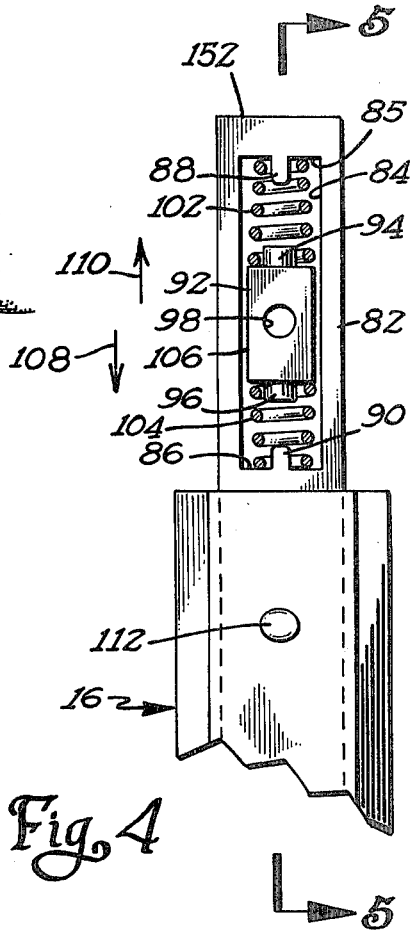
FIG. 4 is a rear elevational view of a portion of the wand member.
Figure 7:
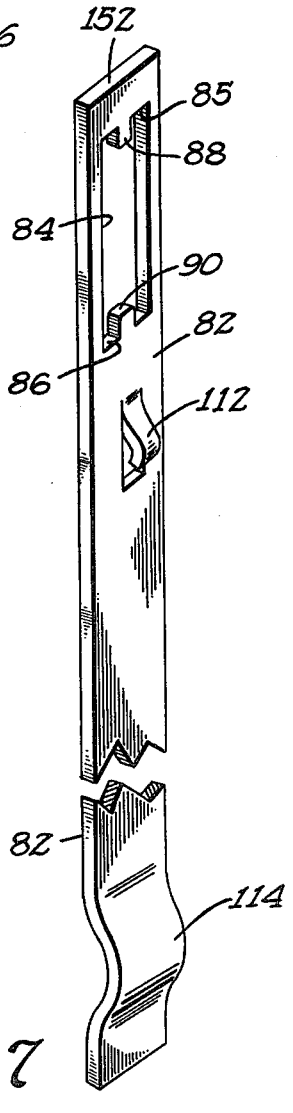
FIG. 7 is a perspective view of a metal strip used in the wand member of FIGS. 1-6.

Referring now to FIGS. 2, 4 and 7, the upper end 80 of the shaft 78 is provided with an elongated strip 82 which is preferably formed of spring steel or other appropriate ferromagnetic material and is embedded in and retained by the fiber glass shaft 78.

As best shown in FIG. 7, the metal strip 82 has a generally rectangular, upright slot 84 with upper and lower edges 85 and 86, respectively, each such edge having a protruding stud 88 and 90, respectively, the studs facing and confronting one another. A movable plunger 92 which may be of circular or square cross section has nipples 94 and 96 at upper and lower ends, respectively, and these nipples confront the studs 88 and 90, respectively. A bore 98 extends transversely through the plunger so as to receive a screw or similiar fastener 100, as will be described more fully hereafter.

Positioned between the nipple 94 of plunger 92 and the stud 88 is an upper coil spring 102. Similarly, a lower coil spring 104 is positioned between the stud 90 and the lower nipple 96 of the plunger, the springs 102 and 104 being under compression and along with the plunger 92 collectively comprising spring means or biasing means for retaining the plunger 92 therebetween and biasing the plunger to a central rest or equilibrium position 106. While a set of coil springs are shown in use with the invention, it should be understood that the term, biasing means, as used herein, includes any means or structure calculated to bias the plunger in the rest position and to return it to such position from a displaced position. Accordingly, other spring structures as well as resilient rubber pads or elastic cords or the like are contemplated and are within the scope of the invention.

The upper spring 102 is selected such that more force is required to move the plunger 92 upward in direction 110 than is required to move the plunger downward in direction 108 against the spring 104. This result may be achieved by selecting a spring 102 with a higher magnitude spring coefficient than that of spring 104. It is desired that greater resistance be encountered in moving the plunger upwardly in direction 110 than downwardly in direction 108 as will be discussed further hereafter.

In the shown embodiment of FIGS. 1-8, the metal strip 82 extends downwardly within the shaft 78 and has an outwardly extending tab 112 which defines an electrode and serves as a stationary switch contact as will be described further hereafter. Adjacent the lower end of the metal strip 82, the strip is creased outwardly to bring the metallic ferromagnetic strip 82 to the surface of the wand member to provide a plate 114 which will directly confront and be attracted to the magnet 74 when the wand member is in initial position 18 and serves as the magnetic medium 76 described in conjunction with FIG. 3. An electric wire or conductor 116 extends from the lower end of the metal strip 82 to a power source 118 which is preferably a battery source.

Figure 5:
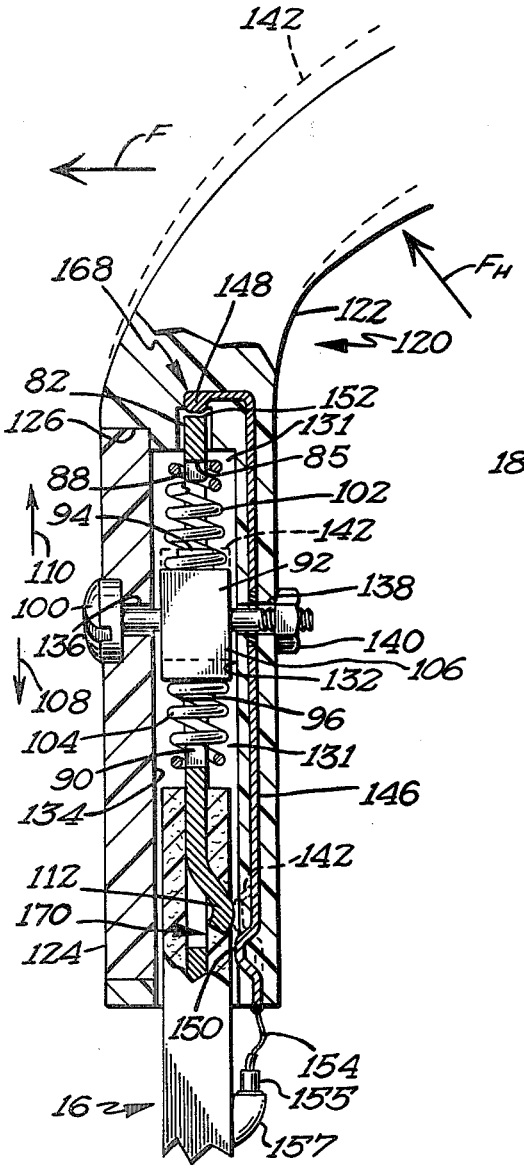
FIG. 5 is a side elevation view of the wand member taken in the direction of arrows 5—5 of FIG. 4 and showing a displaced position of the cap unit in phantom.

Referring now to FIGS. 2 and 5, the wand member 16 also includes a cap unit 120 which moves relative to the shaft in directions 210 and which is comprised of a housing 122 and a cover 124 which fits into an aperture 126 of the housing. The housing 122 has an upper end having an annular mounting surface 128 to which a standard, commercially available tennis ball 130 is attached by gluing or any other means known to the art. The tennis ball 130 comprises a target means which is to be struck by a tennis racket 22 as will be described further hereafter.

The housing 122 has an interior plunger cavity 131 within which the metal strip 82 and moving plunger is contained, the inner wall 132 of the housing and the inner surface 134 of the cover closely confining the plunger 92 therebetween. When the cover 124 is in closed position in aperture 126, a screw 100 is passed through a bore 136 in the cover, and through the communicating bores 98 and 138 of plunger and housing, respectively, a lock nut or cap nut 140 retaining the end of the screw 100. The screw 100 and nut 140 comprise an attachment device for keeping the cover 124 in closed position and for attaching the plunger 92 to the cap unit so the plunger 92 moves relative to the strip 82 but is stationary relative to the cap unit. Accordingly, as the cap unit moves upwardly and downwardly in directions 110 and 108, respectively, the upper and lower springs 102 and 104, respectively, extend and retract, resulting in the plunger 92 and the cap unit being free to float upwardly and downwardly from the central or intermediate rest position 106 to upper and lower displaced positions 142 and 144, respectively.

Preferably, the housing 122 is formed by molding and at the time of molding an electrically conductive contact bar 146 is positioned within the wall of the housing and extends downwardly from the upper end of the plunger cavity 131 where it terminates in a moving switch contact 148. The bar 146 extends downwardly within the housing, and near the lower end of the housing is bent inwardly to form a moving switch contact 150 which is positioned adjacent the stationary switch contact 112 associated with metal strip 82.

Accordingly, when the cap unit 120 moves downwardly in direction 108 to displaced position 144 (FIG. 6), the moving switch contact 148 contacts the upper end 152 of the strip 82 closing the first sensor switch means 168 comprised of contacts 152 and 148. As the cap unit moves upwardly in direction 110 to displaced position 142, the switch 168 opens and moving switch contact 150 contacts stationary switch contact 112, closing second sensor switch means 170 (FIG. 5). Both sensor switches 168 and 170 are in open condition when the cap unit and plunger are in position 106.

Referring now to FIGS. 1 and 2, the lowermost end of the contact bar 146 is electrically connected to an electric wire 154 which extends out of the cap unit and downwardly to a male plug 155 which fits into a receptacle 157 on the wand member 16. The wire 154 then continues within the wand until it reaches the base where it and wire 116 leave the wand and terminate in plugs 198 and 200, respectively, which lead respectively to switch 158 and battery 118. Control box 156 is contained within base 12 and houses an off-on switch 158, an electric alarm means 160 and battery 118. The remaining terminal of switch 158 is connected through wire 159 to the alarm means such as a buzzer, bell or other such electrical sound producing means 160, which in turn, is connected electrically in series with battery 118 through wire 162. Accordingly, the switches 168 and 170, the bell 160, power source 118, and the electrical conductors extending therebetween comprise an alarm means which provides a perceptible audio signal to an operator or player to indicate that a high or low blow has been applied to the ball 130 so as to move the cap unit upwardly or downwardly.

In operation of the first embodiment of the tennis playing apparatus 10, it is anticipated that most blows struck to the tennis ball 130 by the racket 22 will be of the three general types. The most desirable blow is one in the direction F (FIG. 1) wherein at the moment of impact of racket 22 against the ball, the racket will be moved along path F, and upward slightly in direction 164 to put a spin on the ball 130 in direction 166. Naturally, since the ball 130 is rigidly fixed to the cap unit, the ball will not actually spin, but this described and most desirable blow can still be applied by the player to produce the results to be described hereafter.

A second type of blow which may be struck by the operator is an undesirable blow which would result in the ball being knocked downwardly to become a net ball, such applied force being indicated as $F_L$.

The third type of possible blow is a blow which would tend to direct the ball in too high an arc and result in it going out of bounds, such blow being indicated by the arrow $F_H$. The structure of the apparatus 10 permits it to distinguish these three types of blow from one another.

In the event the player administers the desired blow F to the ball 130, the force of the blow displaces the wand member 16 from the initial position 18 to a second position 20 and causes the shaft 78 to become flexed and internal restoring force to be generated within the shaft. The restoring force within the flexed shaft 78 causes the shaft to swing back from the second position 20 to the initial position 18. Often the shaft 78 will not return directly toward the receiving surface 66 of the apex 64 and will instead strike the surfaces 68 or 70 of bifurcated arms 60 and 62, respectively, resulting in the shaft being guided along the arm and into the apex 64. The impact of the returning shaft will at times cause the shaft to bounce on the receiving surface 66, but the presence of the magnet 72 and the magnetic medium 76 in direct confrontation, tends to reduce oscillation or bouncing of the shaft and damps out such movement rapidly. This results in more quiet operation of the apparatus and in the shaft 78 being quickly ready to receive a second blow from the racket.

Referring now to FIG. 5, when the desired blow F is applied to the bail 130, the cap unit 120 moves upwardly slightly in direction 110 so as to simulate a live ball, but such movement is not sufficient to close switch 70. The spring 102 moves the cap unit back to rest position 106. Neither sensor switch 168 or 170 closes, and accordingly, the alarm means is not actuated and the operator knows by the absence of an alarm, that the blow F was a proper one.

In the event the blow by the tennis racket is in direction $F_L$ and of the undesired, downwardly directed type which would produce a net ball, the mast 78 swings from position 18 to position 20 and back, as was described previously, but the behavior of the cap unit 120 is markedly different from that described in conjunction with the desired blow F and will now be described.

Figure 6:
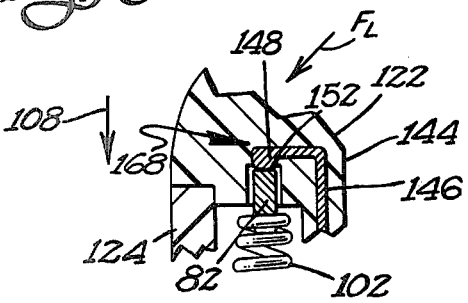
FIG. 6 is a sectional side elevation view of a portion of the cap unit of the wand member of FIG. 5 showing the cap unit in a displaced position.

Referring now to FIGS. 5 and 6, the undesired, low blow $F_L$ causes the cap unit to move downwardly along shaft 78 in the direction 108, resulting in the spring 104 being compressed and causing the moving switch contact 148 to contact the top 152 of the conductive metal strip 82. Physical contact between contact 148 and top 152 effectively closes the first sensor switch 168 as shown in FIG. 6 and actuates the alarm means. On closing of the switch 168, current flows from battery 18 (FIG. 2) along conductor 116, through metal strip 82, across sensor switch 168, along contact bar 146, through wire 154, off-on switch 158, and wire 159 to the bell 160 and back to the battery 118. This current flow results in the bell 160 sounding to indicate to the operator that an unsatisfactory blow has been struck. Immediately after delivering the blow $F_L$, the spring 104 moves the cap unit 120 back to position 106, opening the switch 168. In describing the operation of the alarm means it is presumed that the switch 158 is in a closed condition. A player would open it only to deactivate the alarm in situations where silent operation is desired.

The slight downward movement of the cap unit 120 relative to the shaft in response to the blow $F_L$ provides the feel and impression of a live ball since the ball 130 is permitted to move vertically downward in the direction of the blow $F_L$. The live-ball effect gained by use of the cap unit 120 being movable relative to the shaft makes the striking of the ball 130 feel substantially identical to the striking of a normal free ball in standard tennis playing.

In the event that the blow struck to the cap unit 120 by the racket 22 is an upward blow, such as $F_H$, the wand member swings from the first position 18 to the second position 20 and back again to the initial position, as was described in conjunction with the application of the force F, but the cap unit 120 slides upwardly relative to the shaft 78 in direction 110.

As the cap unit 120 slides upwardly, the moving switch contact 150 slides upwardly into contact with the stationary switch contact defined by tab 112, resulting in the second sensor switch 170 moving to a closed position 142 as shown in FIG. 5. As the switch 170 closes, current flows from the battery 118 (FIG. 2), along conductor 116, through metal strip 82, along tab 112, through contact bar 146 and along wire 154 to and through off-on switch 158, wire 159 and bell 160 to actuate the bell 160, then returning to the battery 118 by conductor 162. Consequently, upward movement of the cap unit 120 in response to an undesired high blow $F_H$ results in the alarm being actuated and the player being thus alerted that the blow was unsatisfactory. Immediately after delivery of the blow $F_H$, the spring 102 moves the cap unit back to position 106, opening the switch 170.

It should be understood that while helpful, it is not as important that an alarm be actuated when an upward blow is struck, as when a downward blow is struck. Frequently, even if an upward blow is delivered, the blow may not be so heavy as to drive the ball out of bounds and the blow may have been acceptable for normal game purposes. A more horizontal blow F is, however, to be preferred, and the apparatus is designed to encourage such blows. For these reasons, the sensor switch 170 may be omitted if desired and only the sensor switch 148 used so as to distinguish horizontal blows F from downward blows $F_L$, and such a variation of the embodiment 10 is contemplated and is within the scope of the invention.

It will also be appreciated by those skilled in the art that even a slight downward blow in the direction $F_L$ would produce a net ball, and accordingly, the spring coefficient of spring 104 is selected to be relatively small and to easily permit the compression of the spring 104 ao as to permit closing of the switch 168 with even slight downward pressure applied to the ball 130. The spring coefficient of the upper spring 102 is greater than that of spring 104 so that only a relatively strong blow in the direction $F_H$ will close the switch 170. This is because an upward blow of moderate force will produce an upwardly angled ball which will still drop within bounds and accordingly the blow would be an acceptable one. An upward blow with excessive force would, however, be adequate to overcome the increased spring force of spring 104 and actuate the alarm.

Figure 9:
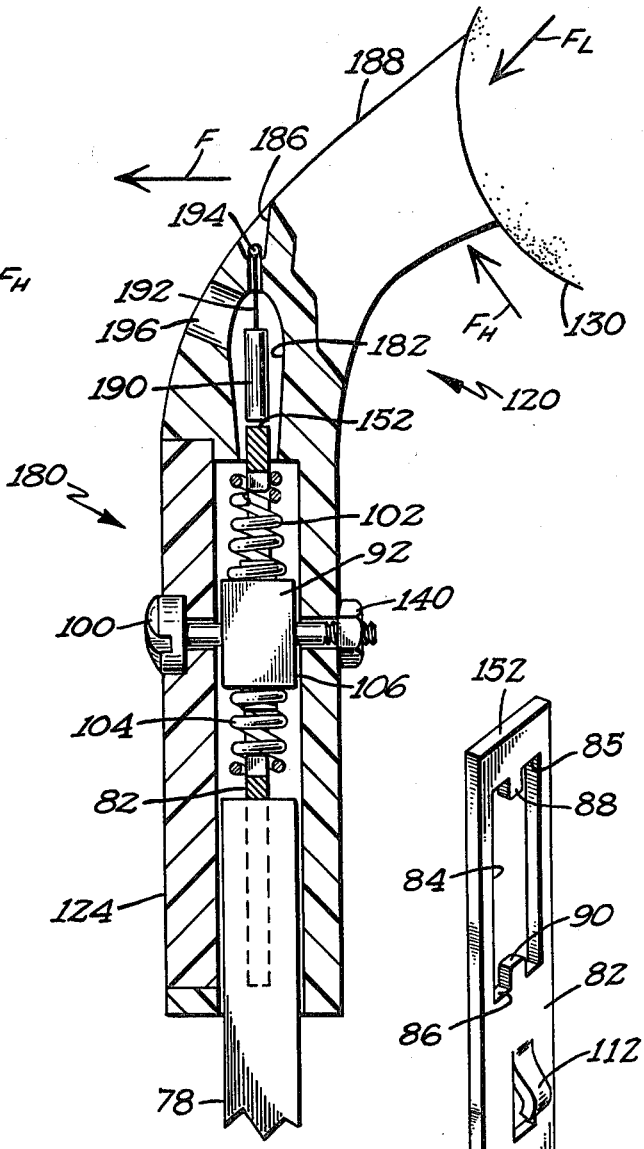
FIG. 9 is a side elevation view of an alternative embodiment of the invention wherein a mechanical alarm system is used.

Referring now to FIG. 9, an alternative embodiment 180 of the invention is shown which utilizes a mechanical alarm in place of the electrical alarm means discussed earlier. The embodiment 180 of FIG. 5 is extremely similar to embodiment 10 described earlier, but no electrical circuitry or switches are used. The portions of the embodiment 180 which are substantially identical to that of the embodiment 10 carry like reference numerals and will not be discussed. The embodiment 180 differs in that the strip 82 is shorter and does not have a tab 112 or plate 114. In addition, embodiment 180 differs in that the cap unit 120 has no bar 146 and that in the embodiment 180, the cap unit has a chamber 182 therein which is positioned directly above the top 152 of shaft 78. The chamber 182 has its upper end provided with a narrow port 184 which extends into a shallow depression 186 on the outer surface 188 of the cap unit 120.

Suspendedly downwardly within the chamber 182 is a musical chime 190 which is hung by a cord or length of monofilament line 192 which has a knot 194 which is captured in the depression 186 and is too large to pass along the port 184. An opening 196 is provided so that the sound of the striking chime 190 may escape from the chamber 182. The chime 190 is positioned directly above the upper end 152 of the metal strip 82 which serves as a striker. A downwardly directed force $F_L$ will drop the chime 190 directly onto the top 152 of the strip or striker 82, causing the chime to ring and indicate that the blow $F_L$ was undesirable.

In operation, the embodiment 180 functions similarly to the embodiment 10. When an acceptable horizontal blow F is applied to the ball 130, the cap unit 120 moves upwardly somewhat in response to the blow and gives the feel of a floating or free ball. The spring 102 then returns the cap unit to rest position 106. When a downwardly directed force $F_L$ is applied to the ball 130, the cap unit is driven downwardly, compressing the lower spring 104 and dropping the chime 190 onto the top 152 of the metal strip 82, resulting in the chime ringing to indicate an improper blow. The compressed spring 104 immediately returns the cap unit 120 upwardly to the rest position shown in FIG. 9 when the force of the blow is removed, and, of course, the shaft 78 in response to each blow swings from initial position 18 to second position 20 (FIG. 1) and returns.

If an upwardly directed blow $F_H$ is applied to the ball 130 of embodiment 180, the upper spring 102 is compressed and the cap unit moves upwardly relative to the shaft 78 and compressed spring 102 thereafter returns the cap unit to its rest position. No alarm is produced in response to upward movement of the cap unit.

As was described in conjunction with the embodiment 10, the upper and lower springs 102 and 104 permit the cap unit to float relative to the shaft 78 and provide the feel of a live ball. The sound of the striking chime 190 escapes from the chamber 182 through the opening 196, and so is easily audible to the player.

While the embodiment 180 has been shown as being provided with an embedded metal strip 82, it should be understood that this metal strip may be replaced by a modified type of wand member having a shaft 78 formed with an integral slot 84 in the fiber glass shaft and the plunger 92 and springs 102 and 104 mounted within such slot. In the embodiment 180, the upper end 152 of the shaft would be provided with a metal cap to serve as a striker to ring the chime 190.

With both the embodiments 10 and 180, it will be noted that the cap unit is easily separated from the shaft 78 by removal of the bolt or screw 100. With such removal, the cover 124 is removed and the housing 122 can then be separated from the shaft 78. With the embodiment 10, one would also disconnect plug 155 from receiver 157. It is most helpful to have the cap unit easily removable because normal wear will eventually wear out the tennis ball 130 and require replacement of the cap unit 120. The described structure makes replacement of the cap unit fast and simple and further facilitates repair or replacement of the springs or plunger.

Accordingly the invention provides a new tennis playing apparatus which solves many of the shortcomings of the known tennis apparatus, one which is easily manufactured, long lasting, and highly effective for teaching proper tennis form.

While the preferred embodiments of the present invention have been described, it should be understood that various changes, adaptations and modifications may be made therein without departing from the spirit of the invention and the scope of the appended claims.

What is claimed is:

1. A tennis playing apparatus usable by a tennis player with a tennis racket to improve skill in swinging of the racket, comprising:

a base;

a post member carried by and extending upwardly from said base;

a substantially elastic, flexible wand member having upper and lower ends, said lower end being carried by said base and said wand member extending upwardly from said base, and including target means adjacent said upper end, said wand member being flexibly movable between an initial position, wherein said wand member contacts said post member, and a second position wherein said wand member is spaced from said post member in response to striking of said target means by the racket;

said post member further including wand receiving means on said post member to receive said wand member as it returns from said second position to said initial position and said wand receiving means including a V-shaped bifurcated receiver having the arms of said V diverging laterally outwardly from an apex so as to receive said wand member therebetween and guide said wand member along said arms as said wand member returns from second to initial position and direct said wand member to said apex;

said wand member further including a shaft and a cap unit;

said cap unit carrying said target means and positioned adjacent the upper end of said wand member and said cap unit being movably mounted relative to said shaft for sliding movement along said shaft between upper and lower displaced positions spaced vertically from an intermediately positioned rest position; and said wand member further including biasing means between said cap unit and said shaft to bias said cap unit to said rest position and to urge said cap unit to said rest position from any displaced position so that said cap unit is free to float relative to said shaft between said displaced positions so as to simulate the feel of a live tennis ball when said target means is struck by the racket.

2. The tennis playing apparatus of claim 1 wherein:

said shaft has an elongated generally upright slot confronting said cap unit;

said biasing means including a plunger positioned in said slot for movement relative to said shaft and between said displaced positions;

said biasing means further including at least one spring positioned in said slot and biasing said plunger to said rest position so as to return said plunger to said rest position from said displaced positions; and an attachment device connecting said plunger to said cap unit so that said cap unit and said plunger move together between said displaced positions.

3. The tennis playing apparatus of claim 1 and further including alarm means positioned on said apparatus and responsive to movement of said cap unit and said plunger from said rest position to a said displaced position to provide a perceptible signal to the player, thereby indicating that an unsatisfactory blow has been struck by the racket.

4. The tennis playing apparatus of claim 3 wherein said alarm means includes:

a chamber within said cap unit and positioned above said shaft; and a chime suspended pendently within said chamber and positioned above said shaft so that downward movement of said cap unit relative to said shaft drops said chime onto said shaft to ring said chime.

5. The tennis playing apparatus of claim 4 wherein said shaft includes a metal striker confronting said chime and said slot is formed in said metal striker.

6. The tennis playing apparatus of claim 3 wherein said alarm means includes:

an electrical power source;

electrical sound producing means for producing an audible signal, said sound producing means being electrically connected with said power source; and first electrical sensor switch means electrically connected with said sound producing means and said power source, said sensor switch means being positioned between said shaft and said cap unit and constructed to be in open condition when said cap unit is in rest position and in closed condition when said cap unit is in a said displaced position so that said sound producing means is energized from said power source to alert a player when said cap unit is moved to a displaced position.

7. The tennis playing apparatus of claim 6 wherein said alarm means further includes second electrical sensor switch means positioned between said cap unit and said shaft and electrically connected with said power source and said sound producing means, said second sensor switch means being in an open condition when said cap unit is in said rest position and in a closed condition when said cap unit is in the remaining said displaced position to cause said power source to energize said sound producing means.

8. The tennis playing apparatus of claim 1 wherein said biasing means includes a plunger and upper and lower springs biasing said plunger and bearing against said plunger, and wherein said upper spring has a larger spring coefficient than does said lower spring so that said upper spring is more resistant to compression.

9. A tennis playing apparatus usable by a player with a tennis racket to improve skill in swinging of the racket comprising:

a base;

a substantially elastic, flexible wand member having upper and lower ends, said lower end being carried by said base and said wand member extending upwardly from said base and including target means adjacent said upper end, said wand member being flexibly movable between an initial rest position to be confronted by a player, and a second position, wherein said wand member is spaced from said initial rest position in response to striking of said target means by a racket; and said wand member including a shaft and a cap unit on said shaft carrying said target means, said cap unit being movably mounted relative to said shaft for movement between a first displaced position and a rest position;

said wand member further including biasing means between said cap unit and said shaft to bias said cap unit to said rest position and to urge said cap to said rest position from said first displaced position so that said cap unit is free to move relative to said shaft between displaced and rest positions so as to simulate the feel of a live ball when said target means is struck by the racket; and said biasing means including a plunger and upper and lower springs biasing said plunger and bearing against said plunger and said upper spring having a larger spring coefficient than does said lower spring so that said upper spring is more resistant to compression.

10. The tennis playing apparatus of claim 9 and further including a magnet carried by one of said members and a magnetic medium carried by the remaining said member, said magnet and said magnetic medium being adjacent and confronting one another when said wand member is in said initial position and cooperating with said arms to damp out oscillatory movement of said wand member relative to said post member and to releasably retain said wand member adjacent said apex in said initial position.

* * * * *

UNITED STATES PATENT AND TRADEMARK OFFICE

CERTIFICATE OF CORRECTION

PATENT NO. : 4,204,678

DATED : May 27, 1980

INVENTOR(S) : Ray P. Weis

It is certified that error appears in the above-identified patent and that said Letters Patent are hereby corrected as shown below:

In claim 9, Col. 12, Line 28:

Insert --unit-- after "cap".

Signed and Sealed this

*Seventh* Day of *October 1980*

[SEAL]

*Attest:*

SIDNEY A. DIAMOND

*Attesting Officer*

*Commissioner of Patents and Trademarks*